US007918104B2

(12) United States Patent
Park et al.

(10) Patent No.: US 7,918,104 B2
(45) Date of Patent: Apr. 5, 2011

(54) WATER COOLING TYPE AIR CONDITIONER

(75) Inventors: In Woong Park, Changwon-si (KR); Ja Hyung Koo, Changwon-si (KR); Seung Cheol Baek, Changwon-si (KR); Soo Yoon Shin, Gimhae-si (KR); Dong Hyuk Lee, Changwon-si (KR); Chang Ryul Kim, Gimhae-si (KR); Man Ho Chun, Seoul (KR); Hyoung Suk Woo, Busan (KR); Yong Taeg Kim, Changwon-si (KR); Sung Rok Ryu, Busan (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 11/797,884

(22) Filed: May 8, 2007

(65) Prior Publication Data

US 2008/0053142 A1 Mar. 6, 2008

(30) Foreign Application Priority Data

Sep. 1, 2006 (KR) ..... 10-2006-0084039

(51) Int. Cl.
*F25B 29/00* (2006.01)

(52) U.S. Cl. ..... 62/325; 62/238.7; 62/324.1; 62/434

(58) Field of Classification Search ..... 62/325, 62/238.7, 434
See application file for complete search history.

(56) References Cited

U.S. PATENT DOCUMENTS 4,257,239 A * 3/1981 Partin et al. ..... 62/238.7
4,399,664 A * 8/1983 Derosier ..... 62/238.7
5,465,588 A * 11/1995 McCahill et al. ..... 62/127

FOREIGN PATENT DOCUMENTS

CN 1212352 A 3/1999
JP 9-113006 A 5/1997
JP 9-196489 A 7/1997

OTHER PUBLICATIONS

Mechanical Engineers' Handbook, 2nd ed., Chapter 52—Heat Exchangers, Vaporizers, Condensers, pp. 1607-1612, copyright 1998 John Wiley & Sons, Inc.*

* cited by examiner

*Primary Examiner* — Cheryl J Tyler
*Assistant Examiner* — Justin Loffredo
(74) *Attorney, Agent, or Firm* — McKenna Long & Aldridge LLP

(57) ABSTRACT

A water cooling type air conditioner is provided. The water cooling type air conditioner includes first and second heat exchangers, a refrigerant pipe, and a direction controlling unit. The first heat exchanger performs heat exchange between air and refrigerant. The second heat exchanger performs heat exchange between the refrigerant and cooling water. The refrigerant pipe is connected between the first heat exchanger and the second heat exchanger to guide a flow of the refrigerant. The direction controlling unit is disposed on one side of the second heat exchanger and controls the refrigerant and the cooling water flowing inside the second heat exchanger to flow in respectively opposite directions.

10 Claims, 9 Drawing Sheets

WATER COOLING TYPE AIR CONDITIONER

This application claims the benefit of Korean Patent Application No. 10-2006-0084039 filed on Sep. 1, 2006, which is hereby incorporated by reference for all purposes as if fully set forth herein.

BACKGROUND OF THE INVENTION

1. Field of the Invention

The present invention relates to a water cooling type air conditioner, and more particularly, to a water cooling type air conditioner having refrigerant and cooling water that flow in respectively opposite directions inside a heat exchanger where heat is exchanged between the refrigerant and cooling water.

2. Description of the Related Art

An air conditioner is an air cooling/heating apparatus that cools and heats air in an indoor space such as an office, a house, etc. The air conditioner operates in a series of cycles including compression, condensation, expansion, and evaporation. Moreover, the air conditioner mainly discharges heat from condensation or evaporation to the outdoors by using outdoor air.

Additionally, air conditioners are generally divided into integrated type air conditioners and split type air conditioners. An integrated type air conditioner includes an indoor unit that conditions indoor air and an outdoor unit in which refrigerant flowing from the indoor unit exchanges heat with the outdoor air. The indoor unit and the outdoor unit are integrated in one body. A split type air conditioner includes a separate indoor unit and outdoor unit. The indoor unit is installed indoors and the outdoor unit is installed outdoors.

Air conditioners perform various additional functions such as an air purifying function, an air dehumidifying function, and so forth, in addition to an air cooling/heating function. The air purifying function suctions and filters polluted indoor air to supply filtered, clean air. The air dehumidifying function dries moist air and supplies dried air into the indoor space.

In an air conditioner according to the related art, heat exchange occurs between the refrigerant and the outdoor air in an outdoor heat exchanger of the outdoor unit. That is, heat is exchanged between the refrigerant flowing in the outdoor heat exchanger and the outdoor air. Accordingly, the outer surface of the outdoor heat exchanger requires a larger contact surface contacting the outdoor air to improve the heat exchange efficiency. Thus, the size of the outdoor heat exchanger increases.

As the size of the outdoor heat exchanger increases, the size of the outdoor unit increases. Moreover, when the size of the outdoor unit increases, the space where the outdoor unit is installed needs to be larger.

Furthermore, as heat is exchanged between the refrigerant flowing in the outdoor heat exchanger and the outdoor air, the heat exchange efficiency differs according to the temperature of the outdoor air. That is, when the temperature of the outdoor air is high, heat is exchanged between the refrigerant in the outdoor heat exchange unit and the high temperature outdoor air. When the temperature of the outdoor air is low, heat is exchanged between the refrigerant in the outdoor heat exchange unit and the low temperature outdoor air.

When heat is exchanged, the temperature of the refrigerant varies according to the temperature of the outdoor air. Therefore, the temperature of the heat-exchanged refrigerant and the heat-exchanged indoor air cannot be uniformly maintained.

Moreover, since the heat exchange efficiency decreases, more energy for operating the air conditioner is consumed, thereby increasing operating expenses.

SUMMARY OF THE INVENTION

Accordingly, the present invention is directed to a water cooling type air conditioner that substantially obviates one or more problems due to limitations and disadvantages of the related art.

An object of the present invention is to provide a water cooling type air conditioner improving cooling and heating efficiency by performing heat exchange of water and refrigerant.

Another object of the present invention is to provide a water cooling type air conditioner maximizing heat exchange in a heat exchanger of the air conditioner by making refrigerant and water flowing in the heat exchanger flow in respectively opposite directions.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a water cooling type air conditioner including: a first heat exchanger performing heat exchange between air and refrigerant; a second heat exchanger performing heat exchange between the refrigerant and cooling water; a refrigerant pipe connected between the first heat exchanger and the second heat exchanger to guide a flow of the refrigerant; and a direction controlling unit disposed on one side of the second heat exchanger and controlling the refrigerant and the cooling water flowing inside the second heat exchanger to flow in respectively opposite directions.

According to the present invention, the water cooling type air conditioner performs heat exchange using refrigerant and water in a second heat exchanger of an outdoor unit.

Accordingly, since more stable heat exchange can be achieved, more effective heat exchange can be obtained compared to the heat exchange of refrigerant and air.

Additionally, refrigerant and cooling water flowing in the second heat exchanger of an outdoor unit flow in respectively opposite directions. That is, the refrigerant and the cooling water flow in respectively opposite directions regardless of cooling or heating operations. Therefore, heat change efficiency increases more compared to a case of when the refrigerant and water flow in the same direction.

Consequently, since energy efficiency increases according to the air conditioner of the present invention, maintenance cost for air conditioning will be reduced. Moreover, since smaller air conditioner can be used due to the energy efficiency, the space availability can be increased.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

A multi water cooling type air conditioner includes a separate indoor unit and outdoor unit. The indoor units are installed at respective indoor spaces to condition indoor air. At this point, the indoor unit is connected to the outdoor unit through a refrigerant pipe. Heat is exchanged when the refrigerant flows between the indoor unit and the outdoor unit through the refrigerant pipe to condition the indoor air.

On the other hand, an integrated water cooling type air conditioner includes an integrated indoor unit and outdoor unit. An appropriate indoor discharge port and indoor suction port are mounted on respective indoor spaces to condition the indoor air. The indoor space is connected to the air conditioner by using a duct. The conditioned air and the indoor air flow through the duct to condition the indoor space.

The multi water cooling type air conditioner will now be described in detail with reference to the accompanying drawings.

Figure 1:
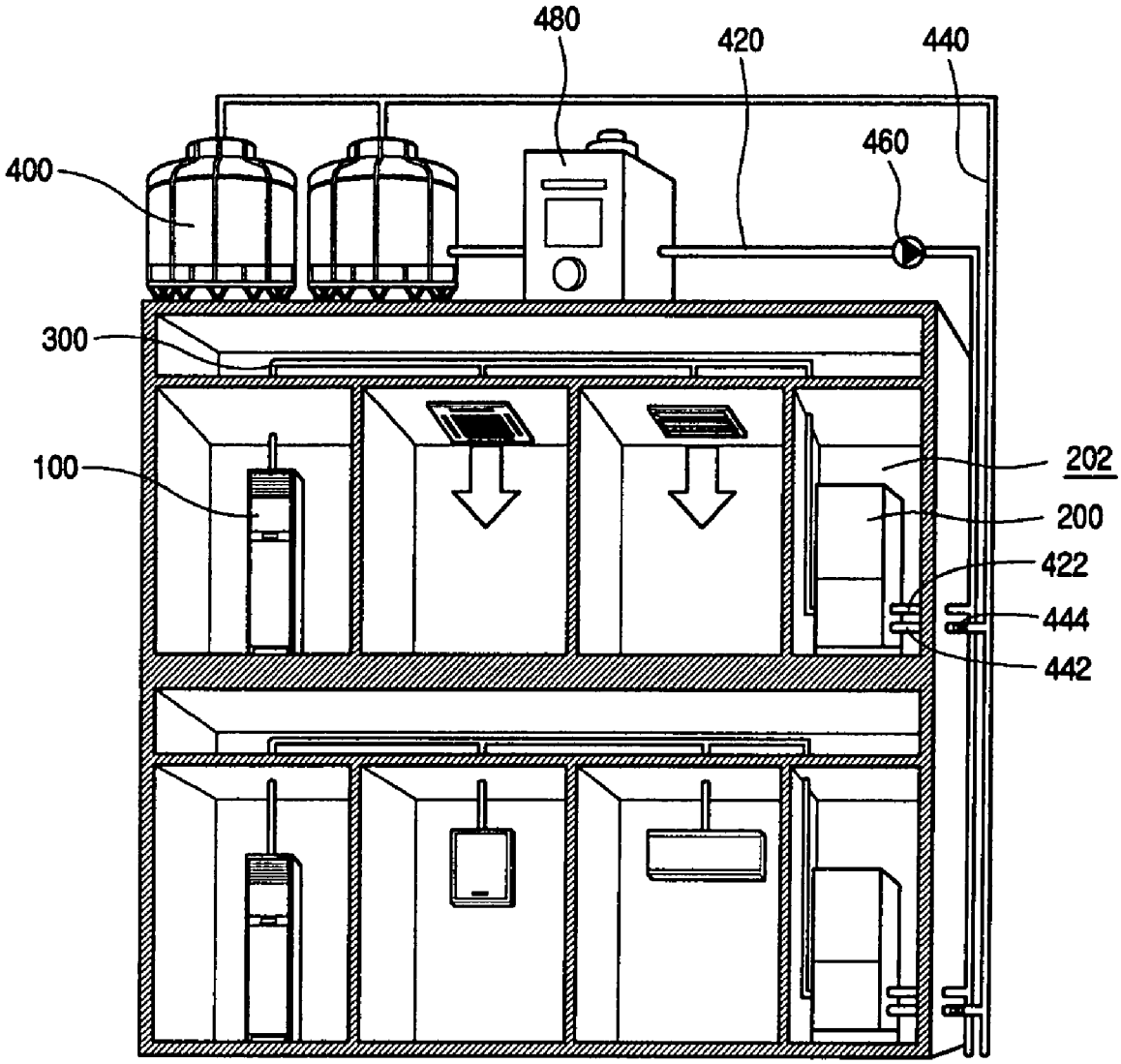
FIG. 1 is a perspective view of a water cooling type air conditioner according to an embodiment of the present invention.
Figure 2:
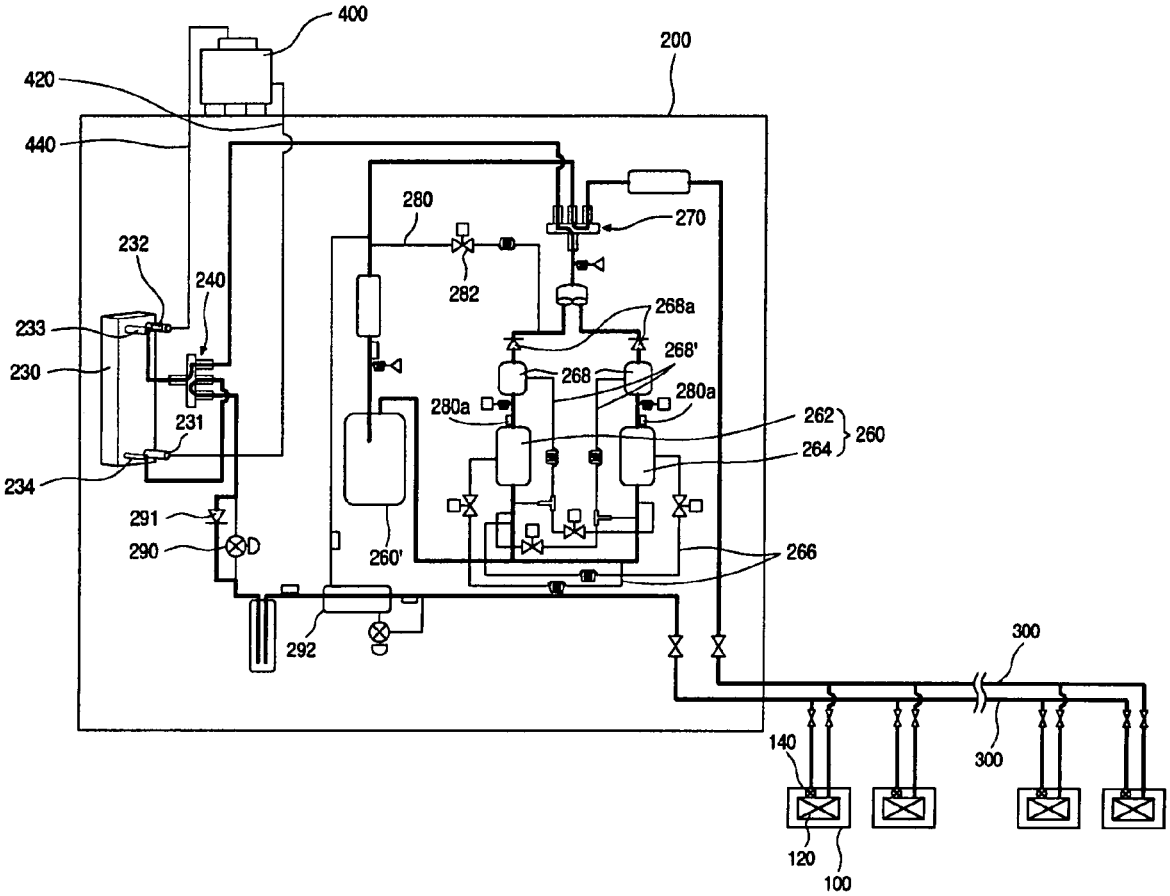
FIG. 2 is a block diagram of a water cooling type air conditioner according to an embodiment of the present invention.

FIG. 1 is a perspective view of a water cooling type air conditioner according to an embodiment of the present invention. FIG. 2 is a block diagram of a water cooling type air conditioner according to an embodiment of the present invention.

The water cooling type air conditioner will be described with reference to FIGS. 1 and 2. The water cooling type air conditioner is installed to condition a plurality of indoor spaces in a large and tall building. Accordingly, the large and tall building having the plurality of indoor spaces requires the water cooling type air conditioner for air conditioning.

The water cooling type air conditioner of the present invention installs respective indoor units 100 at a plurality of indoor spaces of the building. An air conditioning chamber 202 includes an outdoor unit 200 connected to the plurality of indoor units 100 through a pipe, and is located far from a building corner with the indoor unit 100.

Each of the indoor spaces includes the indoor unit 100 having an appropriate form to condition an indoor space. The indoor unit 100 may be in a stand type, a ceiling type, and a wall hanging type. The type can be selected by a user. The indoor unit 100 is connected to the outdoor unit 200 by using a refrigerant pipe 300. The refrigerant pipe 300 guides refrigerant between the indoor unit 100 and the outdoor unit 200.

On the other hand, in the integrated water cooling type air conditioner, each indoor space is connected to an air conditioner through a duct. Thus, a conditioned air in the air conditioner flows into each indoor space through the duct. At this point, the conditioned air flowing into each indoor space is controlled not to be wasted at an unnecessary space, thereby conditioning the indoor air to satisfy requirements of each indoor space.

The indoor unit 100 in the multi cooling water type air conditioner is installed at an indoor space for air conditioning, suctions the indoor air to exchange heat with refrigerant, and reintroduces the heat-exchanged air into the indoor space. Therefore, the indoor air is conditioned according to a user intend. The indoor unit 100 has an appropriate form for conditioning air at the indoor space.

That is, the indoor unit 100 is appropriately formed suited for the size, form, and purpose of the indoor space. The indoor unit 100 includes a stand type, a ceiling type, and a wall hanging type.

The refrigerant pipe 300 having a predetermined diameter is installed to connect the indoor unit 100 and the outdoor unit 200. The refrigerant, that is, operation fluid, flows into the inner space. Accordingly, the refrigerant pipe 300 is connected to the outdoor unit 200 and is diverged into the respective indoor units 100.

On the other hand, a cooling tower 400 for cooling water is installed at a roof of the building having the water cooling type air conditioner. The cooling tower 400 cools water by directly contacting water and air.

That is, when water contacts with air and a portion of water is evaporated, heat for evaporation is taken away from the surroundings. Thus, water temperature decreases. By using this phenomenon, the cooling tower 400 makes water to flow from the top into the bottom direction, and the water cools down by injecting air.

The cooling water generated in the cooling tower 400 is guided by the cooling water supplying pipe 420 to be supplied in the outdoor unit 200. The cooling water supplying pipe 420 has a hollow and circular section and is disposed along an outer wall of the building toward the bottom.

At the side of the cooling water supplying pipe 420, a cooling water retrieving pipe 440 is installed to reintroduce the refrigerant, that is, operation fluid in the outdoor unit 200 and the heat-exchanged cooling water into the cooling tower 400. The cooling water retrieving pipe 440 having a hollow and circular section is installed along an outer wall of the building toward the bottom. Its end is connected to the top of the cooling tower 400.

Accordingly, the cooling water generated from the cooling tower 400 flows into the outdoor unit 200 through the cooling water supplying pipe 420. The cooling water exchanging heat with the refrigerant, i.e., operation fluid, at the inner space of the outdoor unit 200 flows into the top of the cooling tower 400 through the cooling water retrieving pipe 440. Then, the cooling water cools down again at the inner space of the cooling tower 400 to flow into the inner space of the outdoor unit 200. This process is done repeatedly.

A cooling water pump 460 is installed at the cooling water supplying pipe 420 to supply the cooling water generated from the cooling tower 400 into the inner space of the outdoor unit 200 within a predetermined pressure.

The cooling water supplying pipe 420 and the cooling water retrieving pipe 440 extend along the outer wall of the building, and then are diverged into each of the outdoor units 200 to supply the cooling water into the inner space of the outdoor unit 200. That is, a cooling water supply diverging pipe 422 and a cooling water recovery diverging pipe 442, which are diverged from the cooling water supplying pipe 420 and the cooling water retrieving pipe 440 penetrate the side of the air conditioning chamber 202 and are installed at the inside space of the outdoor unit 200.

Likewise, the cooling water supply diverging pipe 422 diverges from the cooling water supplying pipe 420 to supply the cooling water into the inside space of the outdoor unit 200. One end of the cooling water supply diverging pipe 422 is connected to the cooling water supplying pipe 420, and the other end is inserted into the inner space of the outdoor unit 200. One end of the cooling water recovery diverging pipe 442 protruding from the inner space of the outdoor unit 200 is connected to the cooling water retrieving pipe 440.

A cooling water retrieving valve 444 is installed at the cooling water recovery diverging pipe 442 to control a flow of the cooling water retrieved into the cooling water recovery diverging pipe 442 after the cooling water supplied into the inner space of the outdoor unit 200 exchanges heat with the refrigerant in the cooling tower 400.

That is, when the air conditioner operates normally, the cooling water retrieving valve 444 is opened such that the cooling water exchanging heat with the refrigerant in the inner space of the air conditioner is retrieved into the cooling tower 400. When one of air conditioners in the building does not operate, the cooling water retrieving valve 444 is closed to prevent the cooling water filled in the inner space of the air conditioner from flowing into the cooling tower 400.

Moreover, a boiler 480 is installed at one side of the cooling tower 400. The boiler 480 operates to prevent the cooling water from freezing when the water cooling type air conditioner operates in a heating mode or a hot water supplying mode. The cooling water generated from the cooling tower 400 passes through the boiler 480 to flow into the inner space of the outdoor unit 200.

A first heat exchanger 120 is installed at the inner space of the indoor unit 100 to suction air of the inner space for exchanging heat with the refrigerant, thereby conditioning the inner space having the inner unit 100. The first heat exchanger 120 includes a pipe having a circular section and a predetermined diameter. The pipe is bent a couple of times. The refrigerant, i.e., operation fluid, flows in the first heat exchanger 120.

An expansion valve 140 is installed at an inlet of the first heat exchanger 120. The expansion valve 140 expands the refrigerant passing the expansion value 140 to decompress pressure of the refrigerant. That is, a high-pressure refrigerant flows into the expansion value 140, and expands in the expansion value 140 to be in low-pressure.

A refrigerant pipe 300 is connected between the indoor unit 100 and the outdoor unit 200 to guide a flow of the refrigerant. The refrigerant pipe 300 includes a high-pressure pipe where a high-pressure refrigerant flows and a low-pressure pipe where a low-pressure refrigerant flows. The refrigerant pipe 300 connected to the outdoor unit 200 is diverged into each of the indoor units 100 to guide the refrigerant of the first heat exchanger 120.

Accordingly, the refrigerant flows into the outdoor unit 200 along the refrigerant pipe 300, and exchanges heat with the cooling water guided by the cooling water supply diverging pipe 422. The heat exchanged refrigerant flows along the refrigerant pipe 300, and then flows into the first heat exchanger 120 to exchange heat with air of the indoor unit 100 for air conditioning.

Moreover, the cooling water exchanging heat with the refrigerant, i.e., operation fluid, in the outdoor unit 200 is guided by the cooling water recovery diverging pipe 442, and then flows into the inner space of the cooling tower 400. Therefore, the cooling water operates in one cycle.

Figure 3:
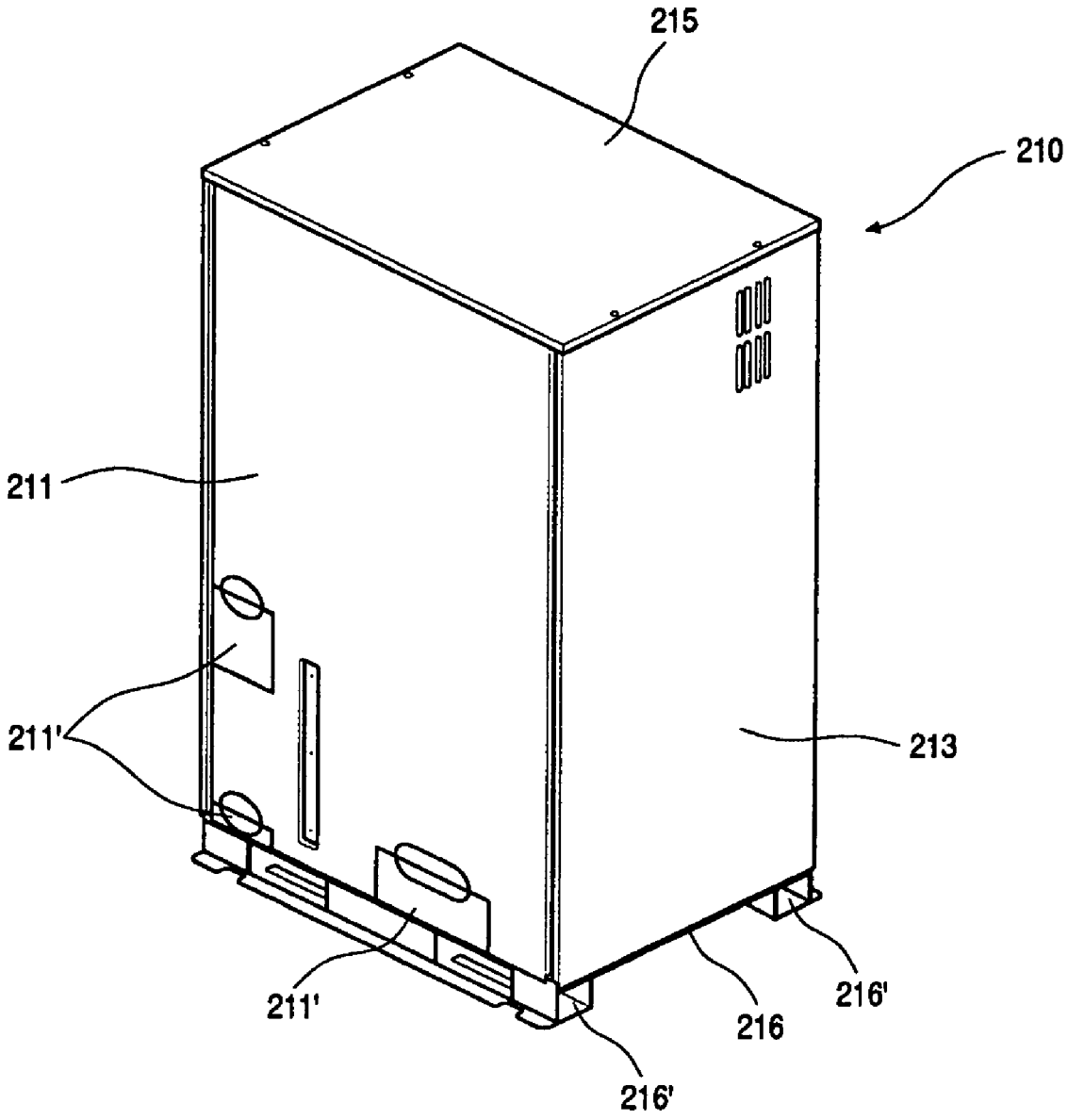
FIG. 3 is an external perspective view of an outdoor unit in a water cooling type air conditioner according to an embodiment of the present invention.
Figure 4:
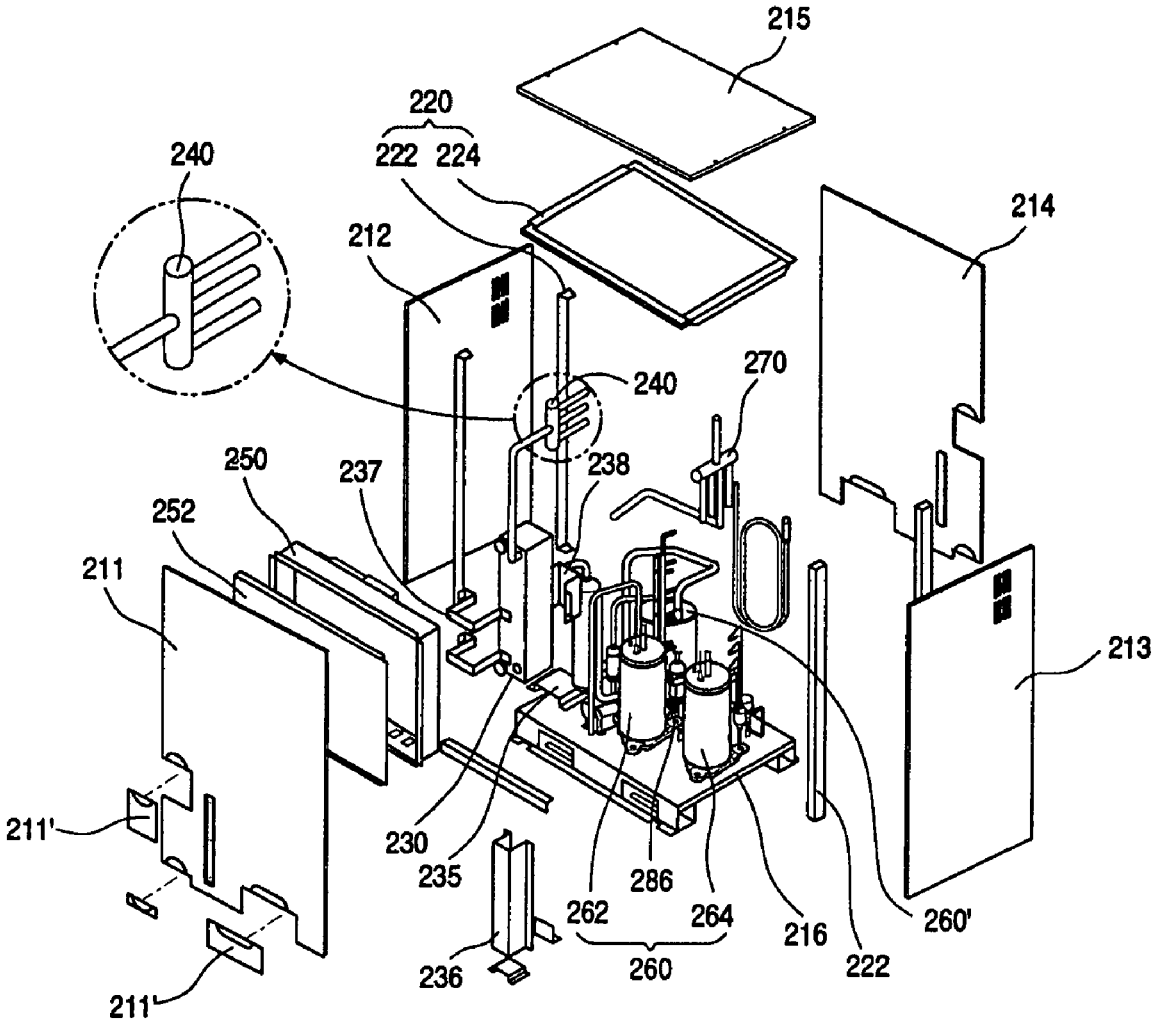
FIG. 4 is an exploded perspective view of an outdoor unit according to one embodiment of the present invention.

FIG. 3 is an external view of an outdoor unit in a water cooling type air conditioner according to an embodiment of the present invention. FIG. 4 is an exploded view of an outdoor unit according to one embodiment of the present invention.

Referring to FIGS. 2 through 4, the outdoor unit 200 will be described in more detail.

The air conditioning chamber 202 of FIG. 1 includes the outdoor unit 200. The outdoor unit 200 is connected to the indoor unit 100 by the refrigerant pipe 300. The outdoor unit 200 is a cabinet 210 including a rectangular parallelepiped. Referring to FIG. 4, the cabinet 210 includes a front panel 211 forming a front appearance, a left panel 212 forming a left appearance, a right panel 213 forming a right appearance, a rear panel 214 forming a rear appearance, a top panel 215 forming a top appearance, and a base panel 216 forming a base appearance.

Accordingly, the cabinet 210 includes a predetermined inner space in which a plurality of parts are installed for air conditioning.

The front panel 211 forming the front appearance of the cabinet 210 includes a plurality of service panels 211' such that a repairman can easily perform a service operation. The service panel 211' can be easily detachable. Therefore, a plurality of parts in the cabinet 210 can be maintained and repaired without removing the front panel 211.

Moreover, the front panel 211 and the rear panel 214 face to each other, and can be interchangeable. The left panel 212 and the right panel 213 face to each other, and can be interchangeable.

The front panel 211 and the rear panel 214, and the left panel 212 and the right panel 213 face each other, respectively. Therefore, the cabinet 210 can be easily assembled, and each panel can be easily manufactured, thereby improving productivity.

The base panel 216 forming the base appearance of the cabinet 210 includes a rectangular plate having a predetermined thickness. Long and rectangular base supporting units 216' are installed in a horizontal direction on the front and the rear in the bottom of the base panel 216.

The base supporting units 216' includes a fork hole (not shown) such that a forklift can lift by using a fork. The base panel 216 is spaced apart from the floor by the base supporting unit 216' such that the outdoor unit 200 can be easily moved.

On the other hand, each of the panels forming the cabinet 210 is formed of a rectangular plate having a predetermined thickness, and is connected to a frame 220 for supporting. The frame 220 includes a vertical frame 222 extending upward from each corner of the base panel 216 and a horizontal frame 224 connecting the top of the vertical frame 222.

The vertical frame 222 has a predetermined thickness and is a long rectangular plate with a vertical direction. The end portion of the vertical frame 222 is bent toward a direction corresponding to each of the corner. The outer surface of the vertical frame 222 is connected to the inner surface of each panel for fixing to form the cabinet 210.

The horizontal frame 224 is connected to the top of the vertical frame 222 for fixing. The horizontal frame 224 has a predetermined thickness and is a long rectangular plate in a horizontal direction. A half of the outer surface in a horizontal direction is bent toward the bottom. The bent surface of the horizontal frame 224 contacts the outer surface of the vertical frame 222.

A second heat exchanger 230, in which the refrigerant exchanges heat with the cooling water, is installed at the base panel 216. The second heat exchanger 230 has a long rectangular form in a vertical direction, and includes a predetermined space therein. The cooling water supplying unit 231 is a path through which the cooling water is supplied, and protrudes toward the front at the front left bottom of the second heat exchanger 230.

The cooling water supplying unit 231 has a cylindrical form with a predetermined diameter and is horizontally disposed to connect the inner space of the cooling water supplying unit 231 and the inner space of the second heat exchanger 230. The cooling water retrieving unit 232 is installed at the top of the cooling water supplying unit 231, i.e., the front top of the second exchanger 230. The cooling water retrieving unit 232 is a path through which the cooling water exchanging heat with the refrigerant in the inner space of the second heat exchanger 230 flows into the outer space of the second heat exchanger 230. (The cooling water retrieving unit 232 corresponds to the cooling water supplying unit 231.

The second heat exchanger 230 is formed by a plate heat exchanger (PHE). The PHE has a long rectangular form in a vertical direction, and includes a predetermined space therein. A plurality of thin plates are disposed at a predetermined interval in the inner space of the second heat exchanger 230 to form space between the thin plates. The refrigerant and cooling water flow through the space.

That is, when the refrigerant, i.e., operation fluid, flows from the top to the bottom in a front space among the spaces between the plurality of thin plates inside the second heat exchanger 230, the cooling water flows from the bottom to the top in the next space. Then, the cooling water flows from the top to the bottom at the following next space. Accordingly, the refrigerant and the cooling water flow in respectively opposite directions, and exchange heat with each other through heat delivered by the thin plate.

The second heat exchanger 230 formed by a PHE is mounted on the top of the base panel 216 by a mounting bracket 235. The mounting bracket 235 is a rectangular bracket having a predetermined thickness, and has a cave-in in the middle thereof. The mounting bracket 235 includes a left end part bent toward the left and a right end part bending toward the right, and contacts the top of the base panel 216.

The bottom of the second heat exchanger 230 is inserted into the center of the mounting bracket 235 for mounting. That is, the bottom of the second heat exchanger 230 is caved in toward the top to correspond to the middle of the mounting bracket 235 such that the center of the mounting bracket 235 can be inserted.

An auxiliary bracket 236 is installed at the right of the second heat exchanger 230 in FIG. 3. The auxiliary bracket 236 has a long rectangular plate in a vertical direction. The middle of the auxiliary bracket 236 is caved in toward the front. The left end and the right end of the auxiliary bracket 236 are bent toward the left and the right, respectively.

A right end of a front bracket 237 supporting the second heat exchanger 230 at the front thereof and a right end of a rear bracket 238 supporting the second heat exchanger 230 at the rear thereof are fastened to the bent surface of the left end of the auxiliary bracket 236. Likewise, the second heat exchanger 230 is connected to a plurality of brackets and mounted on the base panel 216.

The refrigerant inlet 233 is formed on the front right top of the second heat exchanger 230, and is a path through which the refrigerant, i.e., operation fluid, flows into the inner space of the second heat exchanger 230. The refrigerant outlet 234 is formed on the bottom of the refrigerant inlet 230, i.e., the front right bottom of the second heat exchanger 230, and is a path through which the refrigerant flows into the outer of the second heat exchanger 230 after the refrigerant flowing into the inner space of the second heat exchanger 230 exchanges heat with the cooling water.

The refrigerant direction controlling unit 240 maintaining a flow direction of the refrigerant is connected to the refrigerant inlet 233. The refrigerant direction controlling unit 240 includes a four-way valve capable of controlling four directions of fluid flowing. One end of the four-way valve is connected to the refrigerant inlet 233 through a pipe. The other end of the four-way valve is connected to the refrigerant outlet 234, and the refrigerant control value 270 and the outdoor electric value 290, respectively, which are described later.

The refrigerant direction controlling unit 240 allows the refrigerant flowing into the inner space of the second heat exchanger 230 to flow in a direction opposite to the cooling water flowing in the second heat exchanger 230. Accordingly, the refrigerant and the cooling water flowing into the second heat exchanger 230 have respectively opposite directions.

A control box 250 is disposed in the rear of the front panel 211. The control box 250 has a rectangular parallelepiped form with a predetermined space and an opening in the front. The opened front is selectively opened and closed by the control box cover 252 formed in a rectangular parallelepiped form with a predetermined space. A plurality of electric parts are mounted inside the control box 250 to control the water cooling type air conditioner.

A compressor 260 is mounted on the rear of the control box 250. A plurality of the compressors 260 are in a cylindrical form with a predetermined diameter. The compressor 260 compresses the refrigerant to be in a high-temperature and a high-pressure, and is a scroll compressor which has relatively small noise and large efficiency.

The compressor 260 includes a constant speed compressor 262 performing a constant speed operation, and an inverter compressor 264, i.e., a variable speed heat pump. A pair of an oil equalizing pipes 266 connects the constant speed compressor 262 and the inverter compressor 264.

The oil equalizing pipe 266 compensates oil for another compressor 260 when one of the compressors 260 lacks in oil. Therefore, the malfunction of the compressor 260 due to the lack of oil can be prevented.

The constant speed compressor 262 performs a constant speed operation regardless of load capacity. The inverter compressor 264 adjusts a number of rotations according to the load capacity, and thus performs a variable speed operation. That is, when there is a small temperature difference between the indoor space for air conditioning and the outdoor space, or small load capacities for a few number of inner spaces for air conditioning, the inverter compressor 264 operates and the load capacity increases gradually. Then, when the inverter compressor 264 is not capable of performing load capacity, the constant speed compressor 262 operates.

An accumulator 260' is installed at the rear of the compressor 260. The accumulator 260' filters the liquid refrigerant to allow only the gas refrigerant to flow in the compressor 260.

Moreover, the liquid refrigerant among the refrigerant flowing into the indoor unit 100 is filtered by the accumulator 260' not to increase the load of the compressor 260 compressing the refrigerant to be in a high temperature and pressure gas when the refrigerant flows into the compressor 260. Thus, the damage of the compressor 260 can be prevented.

The liquid refrigerant among the refrigerants flowing into the accumulator 260' is relatively heavier than the gas refrigerant. Thus, the liquid refrigerant is stored in the bottom of the accumulator 260', and the gas refrigerant is stored in the top in the compressor 260. Consequently, only the gas refrigerant flows into the compressor 260.

An oil separating unit 268 is installed at an outlet of the compressor 260. The oil separating unit 268 separates oil from the refrigerant. The oil is included in the refrigerant discharged into the outer of the compressor 260. The oil separating unit 268 has a cylindrical form having a predetermined diameter and height.

An oil retrieving pipe 268' is installed at the oil separating unit 268. The oil retrieving pipe 268' supplies the oil, which is separated from the refrigerant in the inner space of the oil separating unit 268, into the inner space of the compressor 260. One end of the oil retrieving pipe 268' is connected to the inner space of the oil separating unit 268. The other end is connected to the inner space of the compressor 260.

That is, the oil is injected into the inside of the compressor 260 to smoothly operate inner parts of the compressor 260 and to cool frictional heat during operations of the compressor 260. A portion of the oil in the compressor 260 is included in the refrigerant that is compressed to be in a high temperature and pressure at the inner space of the compressor 260, and then discharged into the outer of the compressor 260.

Likewise, the oil discharged into the outer space of the compressor 260 together with the refrigerant is separated in the oil separating unit 268, and then is returned back to the compressor 260 through the oil retrieving pipe 268'.

The oil separator checking valve 268*a* is further installed at the outlet of the oil separating unit 268 to prevent the reflux of the refrigerant. The oil separator checking valve 268*a* prevents the compressed refrigerant from flowing back into the inner space of the compressor 260 that is not in work when one of the constant speed compressor 262 and the inverter compressor 264 is not in work.

The oil separating unit 268 is connected to the refrigerant controlling valve 270 through a pipe. The refrigerant controlling valve 270 changes a flow direction of the refrigerant according to an operation mode of the water cooling type air conditioner by using a four-way valve. One of ports in the refrigerant controlling valve 270 is connected to the oil separating unit 268, and the other are connected to the first heat exchanger 120, the second heat exchanger 230, and the accumulator 260', respectively.

A hot gas pipe 280 is further installed at the outlet of the oil separating unit 268. The hot gas pipe 280 directly inputs a portion of the refrigerant flowing into the main control valve 270 into the accumulator 260'.

The hot gas pipe 280 directly inputs the high-pressure refrigerant discharged from the compressor 260 when the low-pressure refrigerant discharged from the accumulator 260' needs to increase pressure during an operation of the water cooling type air conditioner. A hot gas valve 282 is further installed at the hot gas pipe 280 to selectively open and close the hot gas pipe 280.

The refrigerant direction controlling unit 240 is connected to a pipe connecting one of ports of the refrigerant controlling valve 270 and the second heat exchanger 230. The refrigerant direction controlling unit 240 can include various devices and configurations, which can selectively change the direction of the refrigerant flowing into the second heat exchanger 230. However, the refrigerant direction controlling unit 240 having a four-way value will be described.

One port of the refrigerant direction controlling unit 240 having a four-way value is connected to one port of the refrigerant controlling valve 270 through a pipe. Another port of the refrigerant direction controlling unit 240 is connected to the refrigerant inlet 233 of the second heat exchanger 230. Another port of the refrigerant direction controlling unit 240 is connected to the refrigerant outlet 234. Another port of the refrigerant direction controlling unit 240 is connected to the first heat exchanger 120.

An outdoor electric valve 290 is installed at a pipe connecting one port of the refrigerant direction controlling unit 240 and the first heat exchanger 120. The outdoor electric valve 290 controls the degree of openings of the pipe according to an operation mode of the water cooling type air conditioner. The outdoor check valve 291 is installed in parallel to one side of the outdoor electric valve 290.

An over-cooling unit 292 is installed at one side of the outdoor electric valve 290. The over-cooling unit 292 is in a double pipe form and cools the refrigerant more, which is previously heat-exchanged in the first heat exchanger 120 and the second heat exchanger 230.

The water cooling type air conditioner operates according to the flowing direction of the refrigerant flowing in the inner space of the outdoor unit 200. This will be described.

Figure 5:
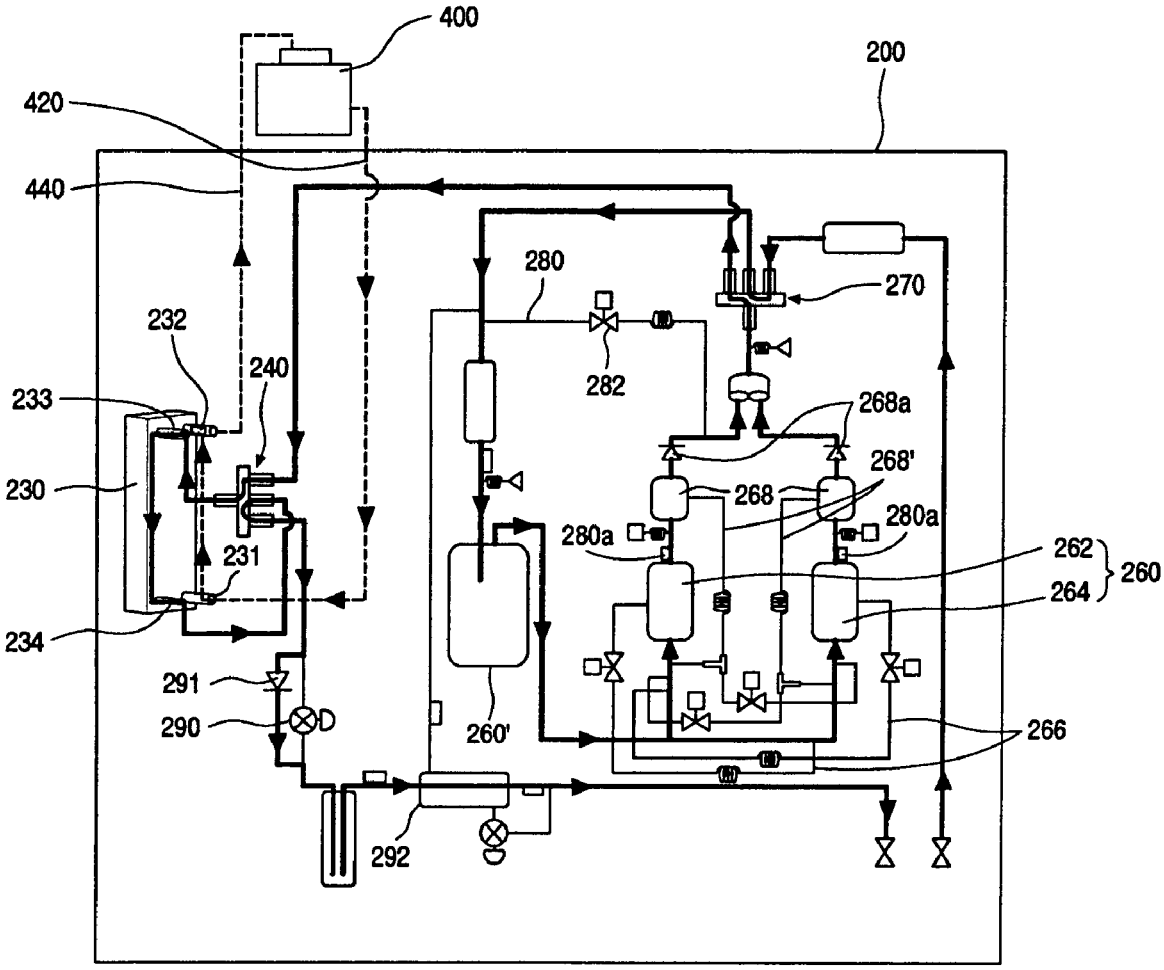
FIG. 5 is a view of a refrigerant flow during a cooling operation according to one embodiment of the present invention.
Figure 6:
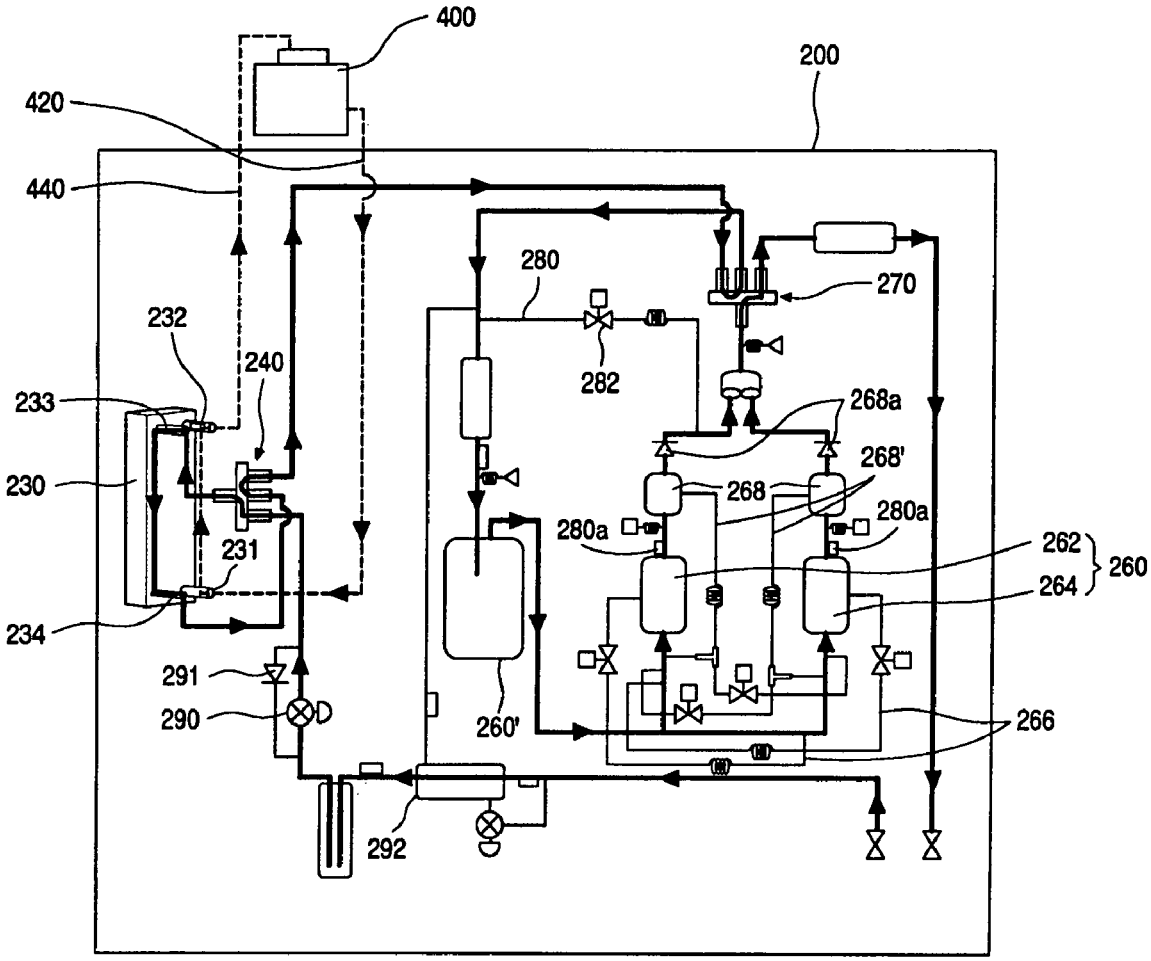
FIG. 6 is a view of a refrigerant flow during a heating operation according to one embodiment of the present invention.

FIG. 5 is a view of a refrigerant flow during a cooling operation (a cooling mode). FIG. 6 is a view of a refrigerant flow during a heating operation (a heating mode).

Referring to FIGS. 2 through 5, the cooling mode of the water cooling type air conditioner will be described.

A user turns external power on to use a water cooling type air conditioner. Then the external power is applied to a plurality of parts in the indoor unit 100 and the outdoor unit 200. When the external power is applied to the compressor 260 in the inner space of the outdoor unit 200, the compressor 260 operates to compress the refrigerant in the compressor 260 to a high temperature and pressure.

The refrigerant compressed to a high temperature and pressure at the inner space of the compressor 260 passes through the oil separating unit 268, and then is separated from the oil. The refrigerant passing through the oil separating unit 268 flows into the refrigerant controlling valve 270, and the oil filtered from the oil separating unit 268 is retrieved into the compressor 260 through the oil retrieving pipe 268'.

The refrigerant flowing into the refrigerant controlling valve 270 flows into the refrigerant direction controlling unit 240 along a pipe connected to one port of the refrigerant controlling valve 270. The refrigerant passes through the refrigerant direction controlling unit 240 and flows into the second heat exchanger 230 through the refrigerant inlet 233.

The refrigerant flowing into the inner space of the second heat exchanger 230 through the refrigerant inlet 233 flows toward the bottom, and is discharged into the outer of the second heat exchanger 230 through the refrigerant outlet 234. The refrigerant flowing through the refrigerant outlet 234 passes through the refrigerant direction controlling unit 240 through one port of the refrigerant direction controlling unit 240 connected to the refrigerant outlet 234, and then passes through the outdoor check valve 291 to flow into the over-cooling unit 292.

The supercooled refrigerant flows along the refrigerant pipe, and then flows into each of indoor units 100. The refrigerant passes through the expansion valve 140 installed at a gate of the first heat exchanger 120, is decompressed to the low-pressure, and then flows into the inside of the first heat exchanger 120.

The refrigerant flowing in the first heat exchanger 120 exchanges heat with air in the indoor space of the indoor unit 100. The heat-exchanged refrigerant flows into the outdoor unit 200 along the refrigerant pipe 40, and is guided into the refrigerant controlling valve 270 through a pipe connected to one port of the refrigerant controlling valve 270.

The refrigerant flowing into the refrigerant controlling valve 270 passes through the refrigerant controlling valve 270 and flows into the inner space of the accumulator 260' by using a pipe connected to the accumulator 260' and another port of the refrigerant controlling valve 270. The refrigerant flowing into the inner space of the accumulator 260' separates the gas refrigerant, and then flows into the inner space of the compressor 260.

The refrigerant, i.e., operation fluid, repeats the above flowing when the air conditioner operates in a cooling mode for a cooling cycle.

Next, the refrigerant flowing according to a heating operation of the water cooling type air conditioner will be described with reference to FIGS. 2 through 6.

When a user turns on the water cooling type air conditioner, the compressor 260 operates to compress the refrigerant to a high temperature and pressure.

The refrigerant compressed to a high temperature and pressure in the compressor 260 passes through the oil separating unit 268 and then separates oil. The refrigerant passing through the oil separator 268 flows into the refrigerant controlling valve 270. The oil filtered from the oil separating unit 268 is retrieved into the inside of the compressor 260 again through the oil retrieving pipe 268'.

The refrigerant passing through the oil separating unit 268 and having a separated oil flows into the refrigerant controlling valve 270, passes through the refrigerant controlling valve 270, and then flows into the inside of the first heat exchanger 120 by a refrigerant pipe 300 connected to the indoor unit 100.

The refrigerant flowing into the first exchanger 120 exchange heat with air in the indoor space, and is converted into a liquid refrigerant having a low temperature and a high pressure. The heat-exchanged refrigerant passes through the expansion valve 140.

The refrigerant passing through the first heat exchanger 120 and the expansion valve 140 is guided by the refrigerant pipe 300 to flow into the inner space of the outdoor unit 200. The refrigerant flowing into the inner space of the outdoor unit 200 passes through the outdoor electric valve 290 to expand and decompress, and then flows into one port of a four-way valve, which is the refrigerant direction controlling unit 240.

The refrigerant flowing into one port of the refrigerant direction controlling unit 240 passes through the refrigerant inlet 233, and then flows into the inner space of the second heat exchanger 230. The refrigerant flows into another port of the refrigerant direction controlling unit 240 through the refrigerant outlet 234. The refrigerant flowing into the refrigerant direction controlling unit 240 passes through another port of the refrigerant direction controlling unit 240, and then flows into one port of the refrigerant controlling valve 270.

A low temperature and pressure liquid refrigerant flowing in the second heat exchanger 230 exchanges heat with the cooling water, and then changes into a low temperature and pressure gas refrigerant. The refrigerant flowing into the refrigerant controlling valve 270 flows in a low temperature and pressure gas state.

The refrigerant flowing into one port of the refrigerant controlling valve 270 flows into another port of the refrigerant controlling valve 270, and passes through the refrigerant controlling valve 270. The refrigerant passing through the refrigerant controlling valve 270 flows into the accumulator 260'. A refrigerant filter in the accumulator 260' filters a liquid refrigerant. Thus, only the gas refrigerant flows into the inner space of the compressor 260 for a heating cycle.

On the other hand, the cooling water in the cooling tower 400 is guided by the cooling water supplying pipe 420, passes through the cooling water supplying unit 231 through the cooling water supplying diverge pipe 422, and then flows into the second heat exchanger 230. The refrigerant flowing into the second heat exchanger 230 passes through the cooling water retrieving unit 232, is guided by the cooling water supplying diverge pipe 422, and flows into the inner space of the cooling tower 400 again through the cooling water retrieving pipe 440.

At this point, the refrigerant passes through the cooling water supplying unit 231 in the second heat exchanger 230, flows into the second heat exchanger 230, and then flows into an outer of the second heat exchanger 230 through the cooling water retrieving unit 232. That is, the refrigerant flows from the bottom of the second exchanger 230 toward the top.

Moreover, the refrigerant flows into the second heat exchanger 230 through the refrigerant inlet 233 of the second heat exchanger 230, and passes through the refrigerant outlet 234 to flow into the outer of the second heat exchanger 230. The refrigerant flows from the top of the second heat exchanger 230 toward the bottom.

Accordingly, the refrigerant and the cooling water flow in respective opposite directions at the inner space of the second heat exchanger 230 for heat exchanging.

It is intended that the present invention covers the modifications and variations of this invention provided they come within the scope of the appended claims and their equivalents.

For example, the refrigerant direction is selectively changed to make the refrigerant and the cooling water to flow in respectively opposite directions in this embodiment. However, the cooling water direction can be selectively changed.

Figure 7:
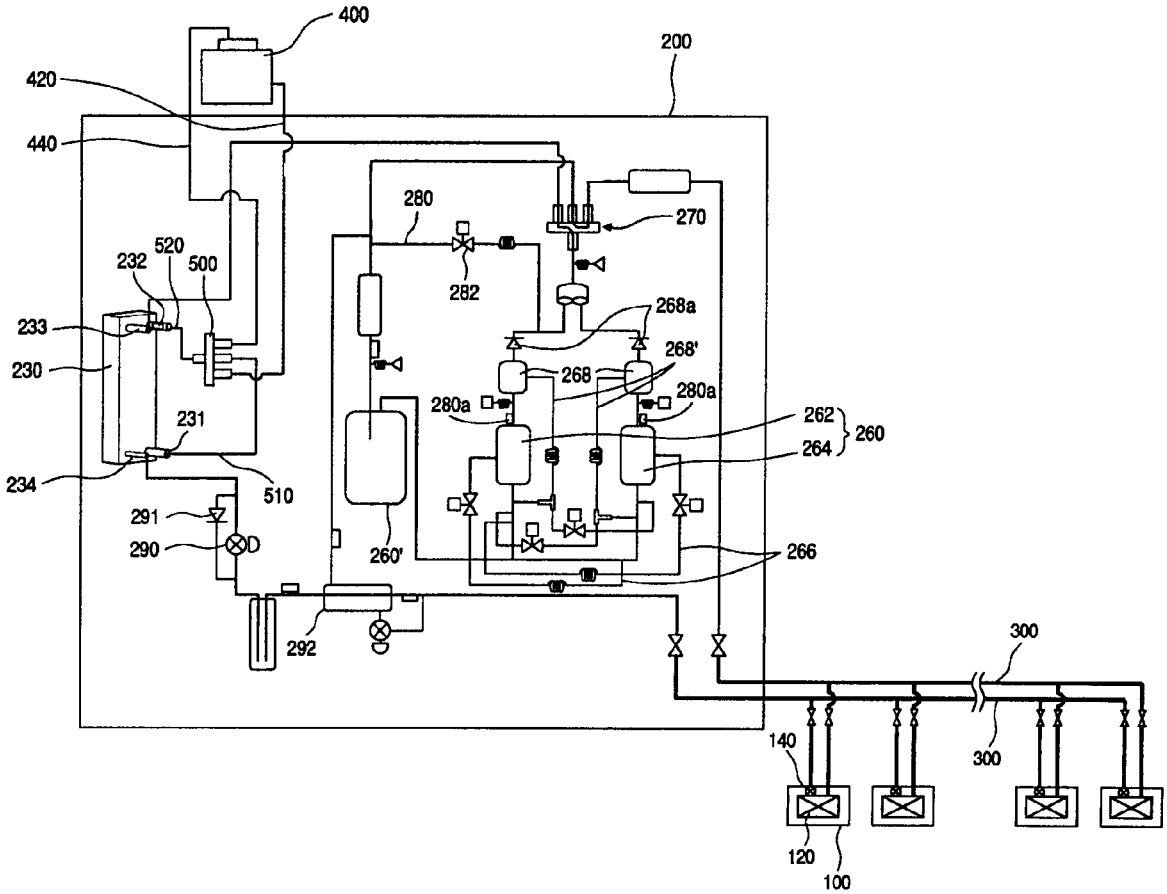
FIG. 7 is a view of a water cooling type air conditioner according to another embodiment of the present invention.

The direction of the cooling water flowing into the second heat exchanger 230 is selectively changed to make the refrigerant and the cooling water flow in respectively opposite directions in FIG. 7.

A water direction controlling unit 500 controlling a water flowing direction is equipped in the outdoor unit 200. The water direction controlling unit 500 is connected to the both ends of the cooling tower 400 for cooling water, and the both ends of the second heat exchanger 230 for exchanging heat, respectively. Accordingly, the water direction controlling unit 500 selectively changes a water flowing direction of the second heat exchanger 230.

More specifically, the cooling water supplying pipe 420 and the cooling water retrieving pipe 440 are connected to the water direction controlling unit 500. That is, the water direction controlling unit 500 includes a four-way valve like the refrigerant direction controlling unit 240. The cooling water supplying pipe 420, the cooling water retrieving pipe 440, the cooling water supplying unit 231, and the cooling water retrieving unit 232 are connected to ports of the water direction controlling unit 500, respectively.

A bottom guide pipe 510 is connected between the water direction controlling unit 500 and the cooling water supplying unit 231 to guide a cooling water flow. The top guide pipe 520 is connected between the water direction controlling unit 500 and the cooling water retrieving unit 232 to guide the cooling water flow.

Figure 8:
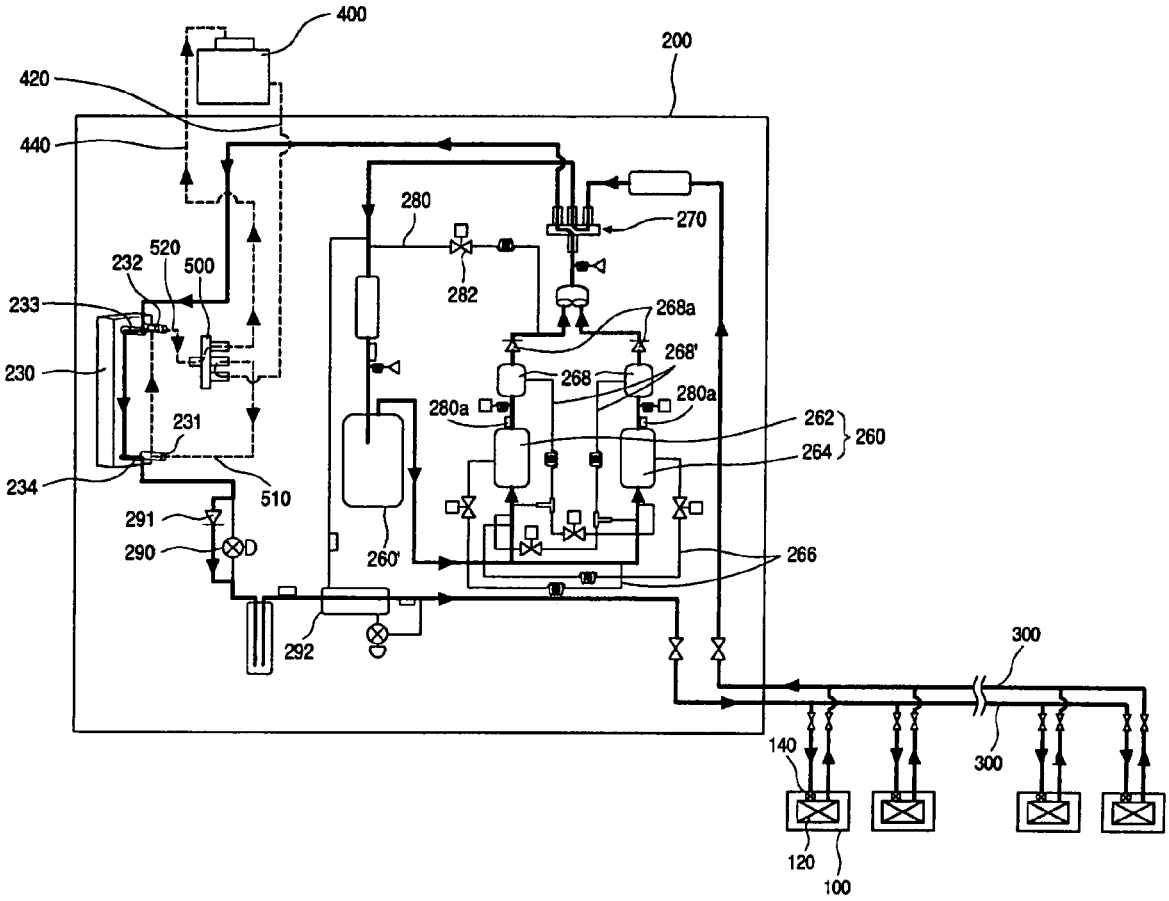
FIG. 8 is a view showing the flow of refrigerant and water during a cooling operation according to the embodiment of FIG. 7.
Figure 9:
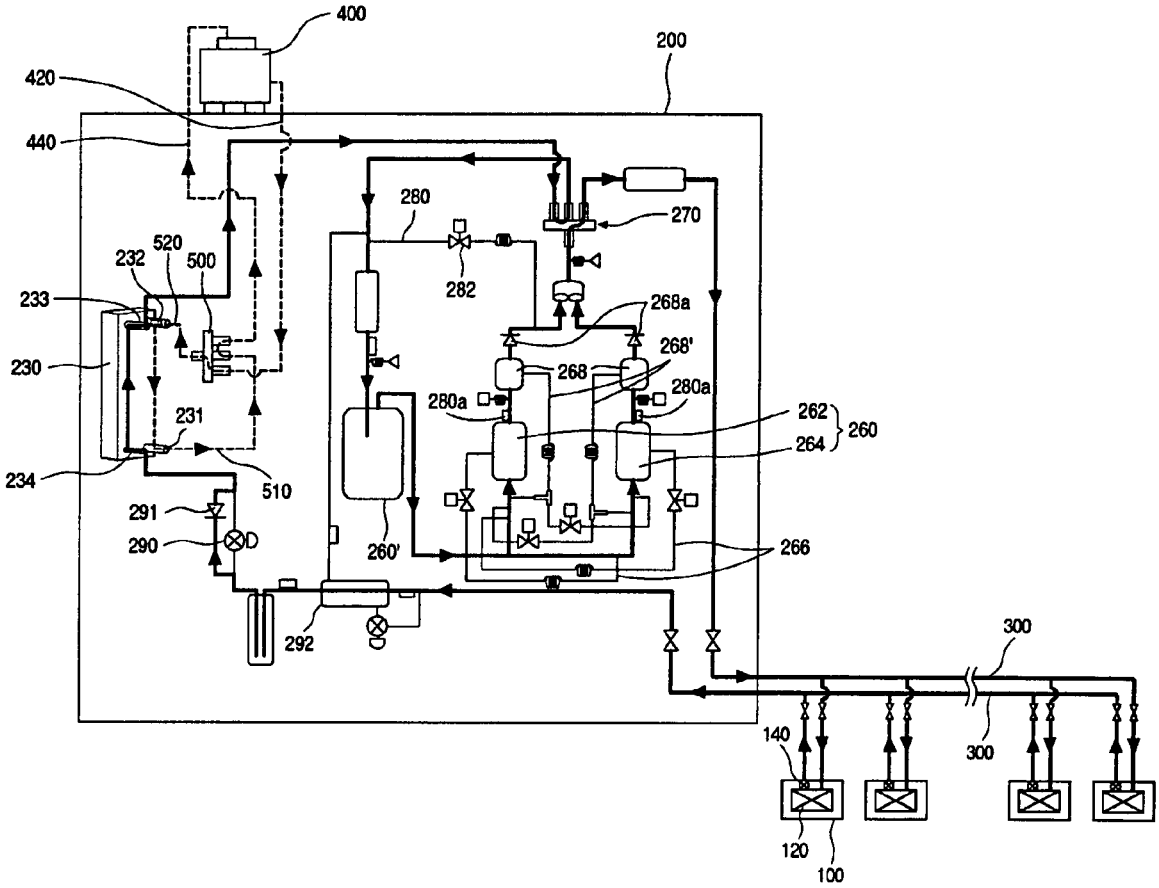
FIG. 9 is a view showing the flow of refrigerant and water during a heating operation according to the embodiment of FIG. 7.

Accordingly, the water direction controlling unit 500 selectively changes a direction of the cooling water that flows into the second heat exchanger 230 in FIGS. 8 and 9.

For example, when the air conditioner is used for cooling air and the refrigerant flows from the top to the bottom in FIG. 8, the cooling water flows from the bottom to the top in the second heat exchanger 230. That is, the cooling water flowing from the cooling tower 400 to the cooling water supplying pipe 420 passes through the water direction controlling unit 500, and is guided into the bottom guide pipe 510.

Accordingly, the cooling water flowing through the bottom guide pipe 510 flows toward the top into the second heat exchanger 230 through the cooling water supplying unit 231. The cooling water exchanges heat with the refrigerant, is discharged through the cooling water retrieving unit 232, and then flows along the top guide pipe 520. The water flowing along the top guide pipe 520 passes through the water direction controlling unit 500, and flows along the cooling water retrieving pipe 440 into the cooling tower 400.

Next, when the air conditioner is used for heating in FIG. 9, the cooling water of the second heat exchanger 230 flows in a direction opposite to FIG. 8. That is, the refrigerant flows from the bottom to the top in the second heat exchanger 230. Accordingly, the cooling water flows from the top to the bottom in the second heat exchanger 230.

More specifically, the cooling water flowing from the cooling tower 400 through the cooling water supplying pipe 420 passes through the water direction controlling unit 500, and changes its direction to be guided into the top guide pipe 520.

Accordingly, the water flowing through the top guide pipe 520 flows toward the bottom into the second heat exchanger 230 by the cooling water retrieving unit 232, and then is discharged through the cooling water supplying unit 231. The cooling water flows along the bottom guide pipe 510. The water flowing along the bottom guide pipe 510 passes through the water direction controlling unit 500, flows along the cooling water retrieving pipe 440, and then is guided into the cooling tower 400.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A water cooling type air conditioner comprising:

a first heat exchanger performing heat exchange between air and refrigerant;

a plate type heat exchanger performing heat exchange between the refrigerant and water, the plate type heat exchanger comprising a plurality of thin plates separated by a predetermined interval for forming spaces comprising an inner space in which the water and the refrigerant flow;

a refrigerant pipe connected between the first heat exchanger and the plate type heat exchanger, for guiding a flow of the refrigerant;

a compressor to compress the refrigerant to a high-temperature and a high-pressure state;

a refrigerant controlling valve for changing a flow direction of refrigerant discharged from the compressor toward the first heat exchanger or the plate type heat exchanger according to an operation mode of the water cooling type air conditioner; and a direction controlling unit disposed on one side of the plate type heat exchanger, for changing a flow direction of the refrigerant flowing into the plate type heat exchanger, wherein the direction controlling unit includes a plurality of ports, wherein the plurality of ports includes a first port, a second port, a third port, and a fourth port, wherein each port is directly connected to the refrigerant controlling valve, a refrigerant inlet of the plate type heat exchanger, a refrigerant outlet of the plate type heat exchanger, and the first heat exchanger, respectively.

2. The water cooling type air conditioner according to claim 1, wherein the flow direction of the refrigerant and water flowing at the inner space of the plate type heat exchanger is constant without being affected by the change of the operation mode of the water cooling type air conditioner.

3. The water cooling type air conditioner according to claim 1, wherein the refrigerant flows into the plate type heat exchanger through the refrigerant inlet of the plate type heat exchanger, and the refrigerant flows out of the plate type heat exchanger through the refrigerant outlet of the plate type heat exchanger, without being affected by the change of the operation mode of the water cooling type air conditioner.

4. The water cooling type air conditioner according to claim 1, wherein when the water cooling type air conditioner operates in a heating mode, the refrigerant discharged from the refrigerant controlling valve flows directly into the plate type heat exchanger through the direction controlling unit, and the refrigerant discharged from the plate type heat exchanger flows directly into the first heat exchanger through the directional controlling unit, and wherein when the water cooling type air conditioner operates in a cooling mode, the refrigerant discharged from the first heat exchanger flows directly into the plate type heat exchanger through the directional controlling unit, and the refrigerant discharged from the plate type heat exchanger flows directly into the compressor through the direction controlling unit.

5. The water cooling type air conditioner according to claim 4, wherein the direction controlling unit comprises a four-way valve for controlling four directions of fluid flow.

6. The water cooling type air conditioner according to claim 5, wherein the direction controlling unit is communicatively connected to the refrigerant pipe and both ends of the plate type heat exchanger, for selectively changing a direction of the refrigerant flowing into the plate type heat exchanger through the refrigerant pipe.

7. The water cooling type air conditioner according to claim 1, wherein the direction controlling unit is a water direction controlling unit for selectively changing a direction of the cooling water flowing into the plate type heat exchanger.

8. The water cooling type air conditioner according to claim 7, wherein the water direction controlling unit comprises a four-way valve for controlling four directions of fluid flow.

9. The water cooling type air conditioner according to claim 8, wherein the water direction controlling unit is respectively connected to a cooling water supplying pipe that guides water flowing from a cooling tower, and a cooling water retrieving pipe that guides water returning to the cooling tower.

10. The water cooling type air conditioner according to claim 8, wherein the water direction controlling unit is communicatively connected to both ends of a cooling tower that cools water and both ends of the plate type heat exchanger that performs heat exchange, and selectively changes a direction of water flowing into or out from the plate type heat exchanger.

* * * * *